US006072887A

United States Patent [19]

Wei

[11] Patent Number: 6,072,887

[45] Date of Patent: Jun. 6, 2000

[54] RECEIVER-TRANSMITTER OF COMMUNICATION EQUIPMENT

[75] Inventor: Wen-Chieh Wei, Taichung, Taiwan

[73] Assignee: Merry Electronics Co., Ltd., Taichung, Taiwan

[21] Appl. No.: 09/035,846

[22] Filed: Mar. 6, 1998

[51] Int. Cl.[7] ..... H04R 25/00

[52] U.S. Cl. ..... 381/412; 381/386; 381/395; 381/344; 379/433

[58] Field of Search ..... 381/412, 386, 381/395, 344, FOR 159; 379/433

[56] References Cited

U.S. PATENT DOCUMENTS 711,974 10/1902 Hyde .
1,084,206 1/1914 Gaynor .
2,205,669 6/1940 Pye .
2,532,413 12/1950 Levy .
3,700,938 10/1972 Bryant .
4,336,425 6/1982 Renkus .
5,166,984 11/1992 Hsiao .

*Primary Examiner*—Curtis A. Kuntz
*Assistant Examiner*—Phylesha Dabney
*Attorney, Agent, or Firm*—Browdy and Neimark

[57] ABSTRACT

A receiver-transmitter for communication equipment is composed of a yoke iron, a magnet and a magnetic pole piece. The yoke iron has a recess in which the magnet and the magnetic pole piece are located. The recess is provided in the bottom thereof with a plurality of locating columns, whereas the magnetic pole piece is provided with a plurality of locating slots. The magnet is securely located in a locating space which is confined by the locating columns. The magnetic pole piece is located at the top of the magnet such that the locating slots of the magnetic pole piece are engaged with the locating columns of the recess.

10 Claims, 3 Drawing Sheets

RECEIVER-TRANSMITTER OF COMMUNICATION EQUIPMENT

FIELD OF THE INVENTION

The present invention relates generally to a communication equipment, and more particularly to a speaker or microphone of the communication equipment, such as a telephone set, earphone, or microphone, etc.

BACKGROUND OF THE INVENTION

As shown in FIG. 1, a prior art receiver-transmitter 10 is composed of a yoke iron 11, a magnet 13, and a magnetic pole piece 15. According to the conventional practice of assembling the receiver-transmitter 10, the magnet 13 and the magnetic pole piece 15 are first held together by means of an adhesive 17. After the adhesive 17 located between the magnet 13 and the magnetic pole piece 15 is dried and hardened, the adhesive 17 is applied to a recess 18 before the magnet 13 and the magnetic pole piece 15 are located at the center of the recess 18 by means of a control device 19. After the adhesive 17 in the recess 18 is dried and hardened, the final assembling work is administered. Such a prior art receiver-transmitter 10 as described above has shortcomings, which are expounded hereinafter.

The process of making the receiver-transmitter 10 is time-consuming in view of the fact that certain steps of the process can not be carried out before the adhesive 17 is dried and hardened.

The amount of the adhesive 17 deposited in the recess 18 must be precise so as to ensure that the magnet 13 and the magnetic pole piece 15 are securely located in the recess 18 with precision.

The quality of the receiver-transmitter 10 is dependent on the quality of the adhesive 17 in view of the fact that the quality of the adhesive 17 plays an important role on determining the holding strength by which the magnet 13 and the magnetic pole piece 15 are held together.

It is difficult to detect the potential problems that are associated with the component parts of a defective receiver-transmitter 10.

The process of making the prior art receiver-transmitter 10 is complicated by the use of the control device 19 for locating the component parts of the receiver-transmitter 10.

SUMMARY OF THE INVENTION

It is therefore the primary objective of the present invention to provide an improved receiver-transmitter which is simple in construction and can be made economically.

It is another objective of the present invention to provide an improved receiver-transmitter consisting of the component parts which are located with precision.

It is still another objective of the present invention to provide a receiver-transmitter consisting of component parts which can be detected for their potential problems by a non-destructive method once the receiver-transmitter has been found to be defective.

In keeping with the principle of the present invention, the foregoing objectives of the present invention are attained by a receiver-transmitter, which is composed of a yoke iron, a magnet, and a magnetic pole piece located on the top of the magnet. The yoke iron has a recess in which the magnet and the magnetic pole piece are located. The recess is provided in the bottom thereof with a plurality of locating columns, whereas the magnetic pole piece is provided with a plurality of locating slots. The magnet is located in a locating space which is confined by the locating columns. The magnetic pole piece is located in the recess such that the locating slots of the magnetic pole piece are engaged with the locating columns of the recess.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
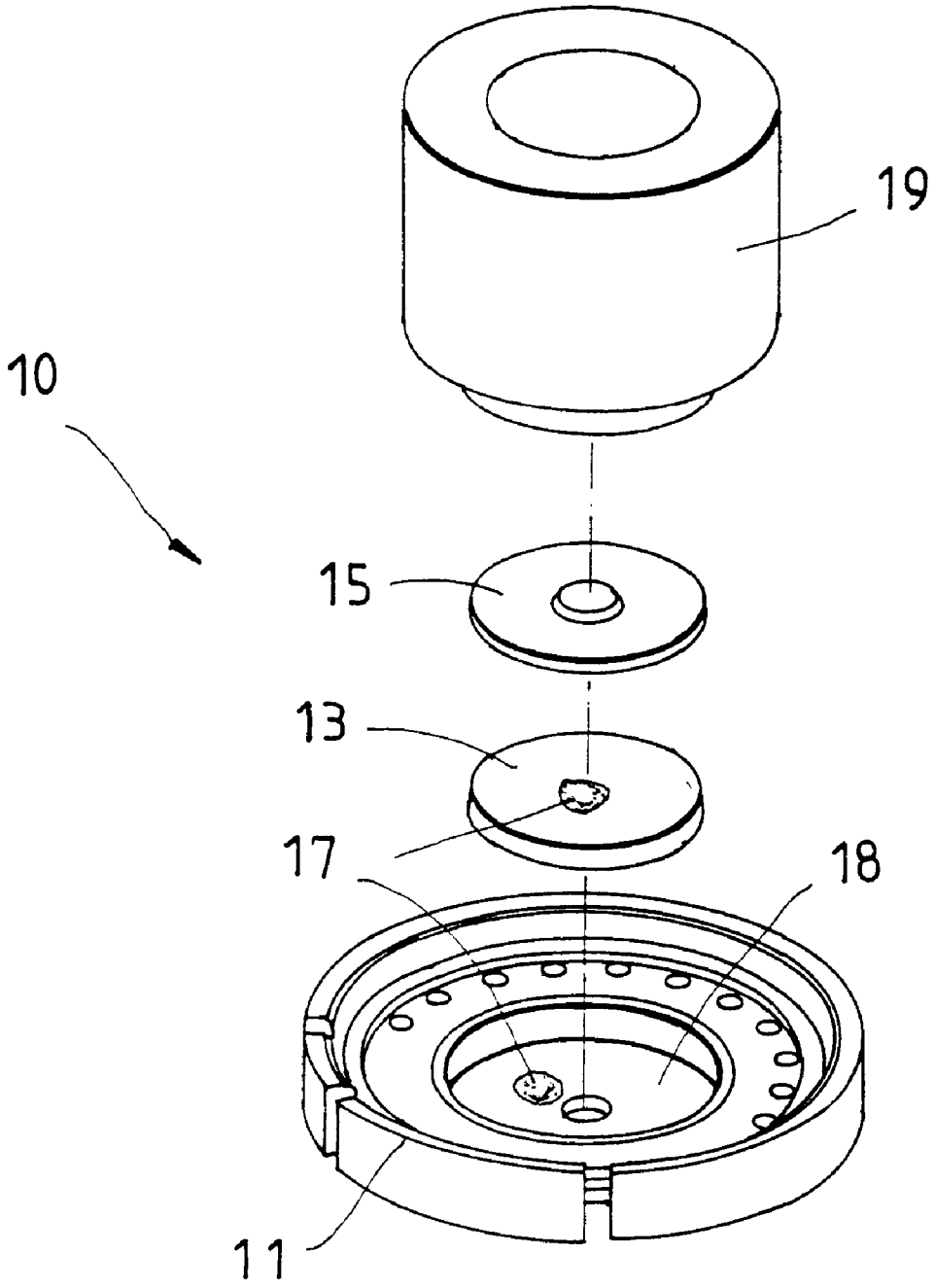
FIG. 1 shows an exploded view of a receiver-transmitter of the prior art.
Figure 2:
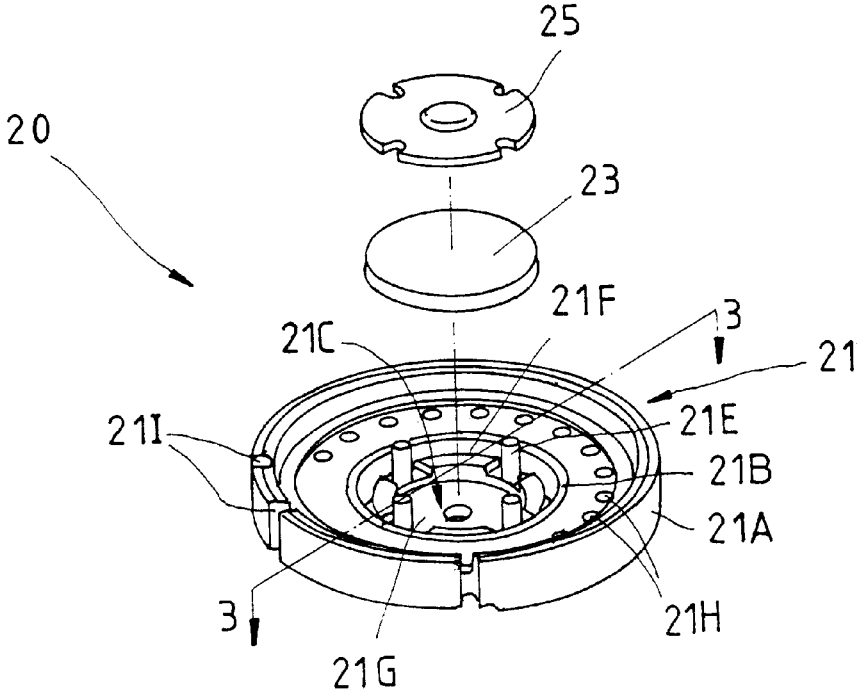
FIG. 2 shows an exploded view of a receiver-transmitter of the present invention.
Figure 3:
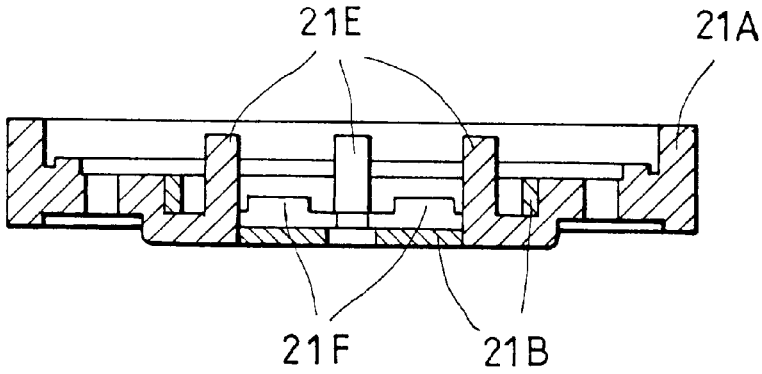
FIG. 3 shows a sectional view of a portion taken along the direction indicated by a line 3—3 as shown in FIG. 2.
Figure 4:
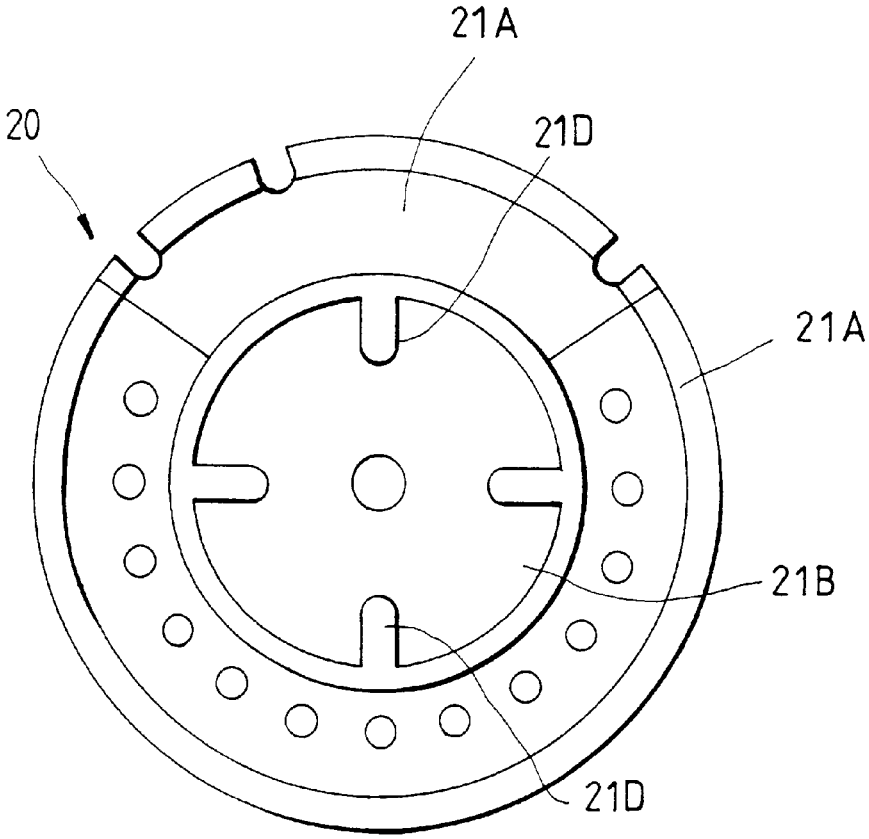
FIG. 4 shows a bottom view of the yoke iron of the receiver-transmitter of the present invention.

As shown in FIGS. 2–4, a receiver-transmitter 20 of the preferred embodiment of the present invention is composed of a yoke iron 21, a magnet 23, and a magnetic pole piece 25.

The yoke iron 21 of a disklike construction has a body 21A made integrally of a plastic material by injection molding. The body 21A is provided at the center thereof with a metal disk 21B for forming a recess 21C. The metal disk 21B is provided in the circumferential edge thereof with four U-shaped indentations 21D which are located equidistantly. The plastic material can pass through the indentations 21D to form four locating columns 21E projecting upwards from the bottom of the recess 21C. The locating columns 21E are reinforced by a plurality of reinforcing ribs 21F formed integrally therewith such that a locating space 21G is formed between one locating column 21E and one reinforcing rib 21F. The body 21A of the yoke iron 21 is provided with a plurality of air holes 21H and is further provided in the periphery thereof with a plurality of furrows 211 for locating the positive and the negative wires of a voice coil.

The magnet 23 of a disklike construction is held in the locating space 21G such that the magnet 23 is located at the center of the recess 21C.

The magnetic pole piece 25 is of a disklike shape and is provided at the center thereof with a protruded portion 25A made integrally therewith by punching. The magnetic pole piece 25 is further provided along the circumferential edge thereof with four U-shaped locating slots 25B which are arranged equidistantly.

Figure 5:
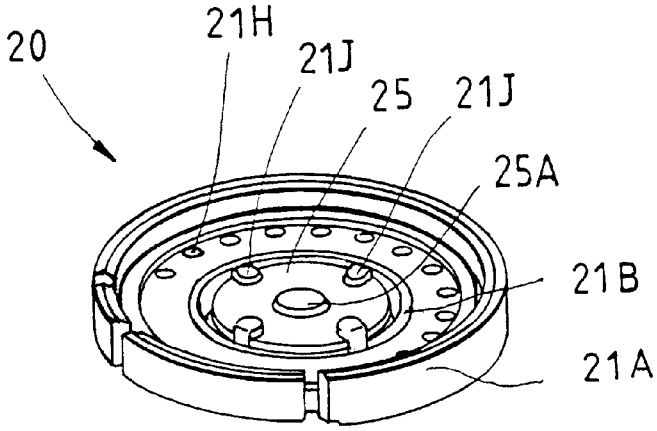
FIG. 5 shows a perspective view of the receiver-transmitter of the present invention.

The magnet 23 is first lodged in the locating space 21G before the magnetic pole piece 25 is arranged on the top of the magnet 23 such that the locating slots 25B of the magnetic pole piece 25 are engaged with the locating columns 21E. In addition, each of the locating columns 21E may be provided at the top end thereof with a retaining portion 21J fastened thereto by a high frequency thermal welding or thermal pressure fastening for confining the magnetic pole piece 25. The retaining portion 215 extends in the direction toward the center of the magnetic pole piece 25, as shown in FIG. 5.

It is therefore readily apparent that the receiver-transmitter 20 of the present invention has advantages over the prior art counterpart in design in that the former is relatively simple in construction, and that the component parts of the former are securely located without the use of the adhesive, and further that the former is relatively cost-effective.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A receiver-transmitter comprising a yoke iron having a recess, a magnet located in said recess, and a magnetic pole piece secured to a top of said magnet; wherein said recess of said yoke iron is provided in a bottom thereof with a plurality of locating columns and a locating space confined by said locating columns; wherein said magnetic pole piece is provided with a plurality of locating slots corresponding in number to and engageable with said locating columns of said recess; and wherein said magnet is located in said locating space such that said locating slots of said magnetic pole piece are engaged with said locating columns of said recess, wherein said locating columns are reinforced by a plurality of reinforcing ribs formed integrally therewith.

2. The receiver-transmitter as defined in claim 1, wherein said locating columns are provided respectively at a top end thereof with a retaining portion fastened thereto for retaining said magnetic pole piece.

3. The receiver-transmitter as defined in claim 1, wherein said locating slots of said magnetic pole piece are arranged equidistantly along a circumferential edge of said magnetic pole piece.

4. The receiver-transmitter as defined in claim 3, wherein said locating slots have a U-shaped cross section.

5. The receiver-transmitter as defined in claim 1, wherein said locating columns are four in number.

6. A receiver-transmitter comprising a yoke iron having a recess, a magnet located in said recess, and a magnetic pole piece secured to a top of said magnet; wherein said recess of said yoke iron is provided in a bottom thereof with a plurality of locating columns and a locating space confined by said locating columns; wherein said magnetic pole piece is provided with a plurality of locating slots corresponding in number to and engageable with said locating columns of said recess; and wherein said magnet is located in said locating space such that said locating slots of said magnetic pole piece are engaged with said locating columns of said recess, wherein said yoke iron has a body formed integrally of a plastic material by injection molding, said body provided at a center thereof with a metal disk serving as said recess and having along a circumferential edge thereof a plurality of indentations for allowing plastic material to pass therethrough to form said locating columns.

7. The receiver-transmitter as defined in claim 6, wherein said locating columns are provided respectively at a top end thereof with a retaining portion fastened thereto for retaining said magnetic pole piece.

8. The receiver-transmitter as defined in claim 6, wherein said locating slots of said magnetic pole piece are arranged equidistantly along a circumferential edge of said magnetic pole piece.

9. The receiver-transmitter as defined in claim 8, wherein said locating slots have a U-shaped cross section.

10. The receiver-transmitter as defined in claim 6, wherein said locating columns are four in number.

* * * * *